US005575167A

United States Patent [19]

Gottschalk et al.

[11] Patent Number: 5,575,167

[45] **Date of Patent: *Nov. 19, 1996**

[54] DEEP ROLLING SPLIT-PIN FILLETS OF CRANKSHAFTS

[75] Inventors: William P. Gottschalk, Davisburg; Hans T. Lauten, Commerce Township, both of Mich.

[73] Assignee: Hegenscheidt Corporation, Troy, Mich.

[ * ] Notice: The term of this patent shall not extend beyond the expiration date of Pat. No. 5,445,003.

[21] Appl. No.: 374,029

[22] Filed: Jan. 18, 1995

Related U.S. Application Data

[63] Continuation-in-part of Ser. No. 242,262, May 13, 1994, Pat. No. 5,495,738, and a continuation-in-part of Ser. No. 176,792, Jan. 3, 1994, Pat. No. 5,445,003.

[51] Int. Cl.[6] ..... B21K 1/08

[52] U.S. Cl. ..... 72/110; 72/107

[58] Field of Search ..... 72/107, 110; 29/6.01

[56] References Cited

U.S. PATENT DOCUMENTS

| | | | |
|---|---|---|---|
| 4,561,276 | 12/1985 | Berstein | 72/81 |
| 5,001,917 | 3/1991 | Berstein | 72/110 |
| 5,138,859 | 8/1992 | Winkens | 72/110 |
| 5,333,480 | 8/1994 | Berstein | 72/110 |
| 5,445,003 | 8/1995 | Gottschalk et al. | 72/110 |

FOREIGN PATENT DOCUMENTS

| | | | |
|---|---|---|---|
| 60-24319 | 2/1985 | Japan | 29/6 |

*Primary Examiner*—Lowell A. Larson
*Attorney, Agent, or Firm*—Reising, Ethington, Barnard & Perry

[57] ABSTRACT

Machine and method for deep rolling fillets of split-pins of engine crankshafts. Each split-pin comprises neighboring and arcuately offset crank pins connected between counter weights and has a centralized splitter fence which receives side loads from the connecting rods. Annular fillets are formed between the pins and opposite sides of the splitter fence as well as between the fillets and their associated counter weights. Limbs of the fillets at the splitter fence that describe the overlap of the split-pins are deep rolled with a high load for improving yield strength while the remaining arcuate portions of the fillets are rolled at lower loads to improve strength without undue distortion of the fence. The overlap of pin to main journals can also be rolled with increased load for increased yield strength.

6 Claims, 6 Drawing Sheets

DEEP ROLLING SPLIT-PIN FILLETS OF CRANKSHAFTS

RELATED APPLICATION

This application is a continuation-in-part of application Ser. No. 08/242,262, filed on May 13, 1994, now U.S. Pat. No. 5,495,738 issued Mar. 5, 1996, and application. Ser. No. 08/176,792 filed Jan. 3, 1994, now U.S. Pat. No. 5,445,003 granted Aug. 29, 1995.

BACKGROUND OF THE INVENTION

This invention relates to the deep rolling and strengthening of fillets of crank pins of internal combustion engine crankshafts and, more particularly, to variable pressure fillet rolling of the fillets of split and arcuately offset crank pins.

Internal combustion engines conventionally have cast iron or steel crankshafts with throws incorporating integral crank pins which provide the pivot attachment points for the connecting rods coupling the pistons and the crankshaft. Since these crank pins experience high gas pressure loads and inertia forces during engine operations, their fillets are usually cold worked and hardened by deep rolling with special machinery during initial manufacture to increase their operational yield strengths. With such strengthening, there is improved crankshaft performance and service life.

With many V-block engines, adjacent and neighboring crank pin journals of the engine crankshaft are split and arcuately offset to mount the ends of connecting rods of opposing pistons in a side-by-side manner. The split pins of a V-6 crankshaft may be designed with their axes of revolution arcuately offset by an included angle of 30 degrees, for example. With such offset, each of the cylinders can be fired at 120 degree intervals or three times per crankshaft revolution to provide an even firing engine. Other angular offsets are used with other crankshafts for other internal combustion engines.

Crankshafts with such split pin design may be provided with a divider fence at the split of the pins to enable fillet rolling at the fence connecting the split-pins to one another. This fence importantly provides a thrust wall to receive side loads from the connecting rods of the pistons and strengthens the pins particularly at the overlap of the two fillets. With the fence separating the annular fillets from one another, fillets on opposite sides of the fence can be fully rolled and strengthened through 360 degrees.

The overlap of the two adjacent annular fillets in transparent end view is generally in the cross sectional shape of a football with the upper segment of the football formed by a limb of a first fillet while the lower segment is formed by a limb of the second fillet. With this overlap configuration the present invention has been devised to provide high pressure rolling and accompanying work hardening of the fillets at their overlap with backing by the offset of the pins and to provide lower pressure deep rolling of the fillets outside of the overlap to reduce distortion of the divider fence. This deep rolling importantly improves strength of the crankshaft at otherwise weakened sections necessitated for smoother engine operations.

DESCRIPTION OF RELATED ART

Prior to the present invention, various machines and methods have been devised for rolling fillets of crankshafts with variable pressure. For example, prior art U.S. Pat. Nos. 5,001,917 and 5,333,480, dated Mar. 26, 1991 and Aug. 2, 1994, respectively, disclose machines and methods for rolling crankshafts with variable pressure. However, such rolling is for crankshaft straightening purposes and is not drawn to deep rolling crankshafts having split pin construction as in the present invention. More particularly, there is no prior art recognition of any continuous variable pressure rolling of split and arcuately offset crank pins for (1) optimizing fillet strength in the overlap portions of the pin fillets, and (2) rolling the arcuate areas outside of the overlap without undue distortion of the unsupported portion of the fence at the split.

THE PRESENT INVENTION

In contrast to the prior art machines and methods, the present invention is drawn to new and improved machines and methods which permit the continuous 360 degree rolling of fillets of split pin crankshafts with high pressure deep rolling in the split or overlap regions of the fillets at which the pins are connected to one another. This invention also provides for the high pressure deep rolling of the overlap of fillets between the pins and main journals. In the preferred machine and method of the present invention, the split-pins have their outer fillets rolled in a first rolling operation in a manner similar to that disclosed in parent applications Ser. Nos. 08/176,792 and 08/242,262. In the present invention, the interior fillets are continuously rolled at variable high pressures. More particularly, high pressure rolling is precisely employed in the arcuate sections of the fillets where the split-pins overlap while the arcs or limbs of the fillets outside of the overlap are rolled at a lower pressure. This ensures the production of highly concentrated residual stress patterns and maximum strength at the overlap while preventing distortion of the unsupported sections of the fence separating the pins which would detract from operation of the crankshaft in an engine.

A feature, object and advantage of this invention is to provide machinery with controls and methods to deep roll the fenced fillets of arcuately offset split-pins of crankshafts for internal combustion engines with first stage rolling in which all of the outer fillets of the split-pins are deep rolled at a first load. The invention further provides second stage rolling featuring high load rolling of the fillet overlap and a lower load rolling of the fillets outside of the overlap which are not backed by pin offset. The first and second stages can be interchanged if desired so that second stage rolling is first performed and is followed by first stage rolling.

One preferred deep rolling method of this invention involves rolling of the outer fillets of each split pin in a first rolling operation with a substantially constant rolling force, and subsequently, variable pressure rolling the adjacent interior and overlapped split-pin fillets with pressures needed for optimum fillet strength of the overlap. In a similar preferred method, the rolling steps may be reversed with the inner fillets deep rolled initially with variable pressure and the outboard fillets subsequently rolled with a substantially constant pressure. In some instances the rolling of the outer fillets is accomplished with variable pressure or is completely eliminated.

It is another feature, object and advantage to deep roll pairs of fillets of split and arcuately offset pins of a crankshaft which overlap with pairs of tools with localized high rolling pressures in which (1) a first tool rolls a first annular fillet of one of the split-pins with increased pressure through a first roller at the overlap and reduced pressure outside of the overlap, and (2) a second tool simultaneously rolls a second and offset annular fillet of the split-pin with increased pressure through a second roller at the overlap and reduced pressure outside of the overlap to encompass a "football-shaped" area where the split-pins interface.

In this invention different tooling can be used on one machine in two stages of operation. Also separate machines and stations for two stages of rolling can be used. This invention also provides a machine for rolling all of the overlapping neighboring fillets simultaneously. To this end, the machine and crankshaft can be relatively moved with respect to one another so that all overlapped fillets can be rolled with a single machine.

These and other features, objects and advantages of the invention will become more apparent from the following detailed description and drawings in which:

DETAILED DESCRIPTION OF THE DRAWINGS

Figure 1:
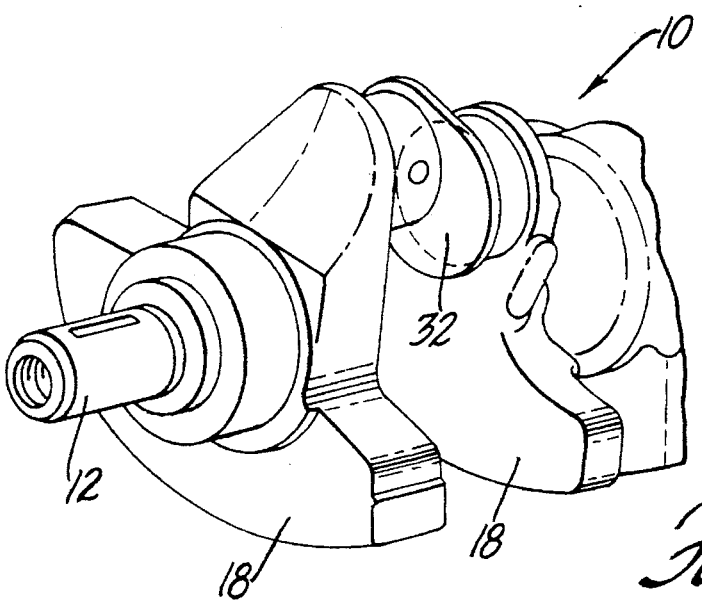
FIG. 1 is a pictorial view of a portion of a crankshaft for an internal combustion engine having split-pin construction.
Figure 2:
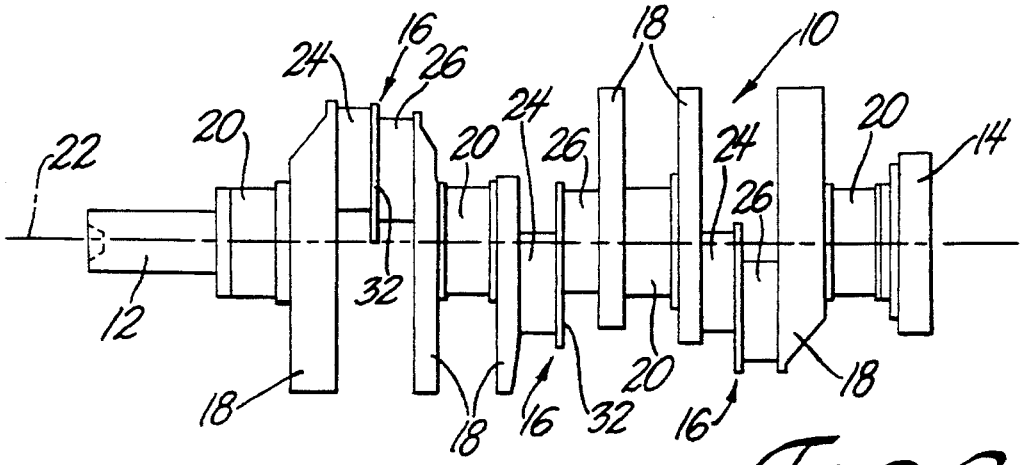
FIG. 2 is a side elevational view of a crankshaft with three pairs of fenced split-pins.

Turning now in greater detail to the drawings, there is shown in FIGS. 1 and 2 a cast iron or steel crankshaft 10 for a V-type internal combustion engine. The crankshaft has front and rear ends 12 and 14, and three pairs of split-pins 16 connected between the six laterally disposed counterweights 18. Main bearings 20 are provided adjacent to opposite ends of the crankshaft 10 and between the counterweights 18 that separates the pairs of split-pins as shown in the drawings. The mains 20 as well as the front and rear ends 12 and 14 of the crankshaft are disposed along the rotational axis 22 and connect to the counterweights 18, as shown.

Since the opposing pistons in the left and right banks of the engine block connect to the same pair of split-pins, one bank of pistons and their cylinders must be slightly ahead of the other bank of pistons and their associated cylinders. Accordingly, the pins 24 lie in planes parallel to the planes of their adjacent or neighboring pins 26.

Figure 3:
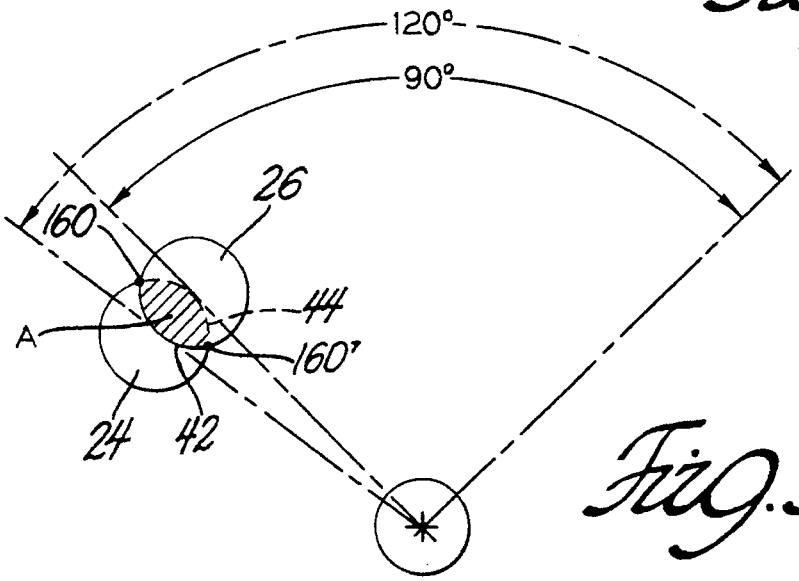
FIG. 3 is a diagram illustrating the overlap of split-pins for an even firing engine.
Figure 4:
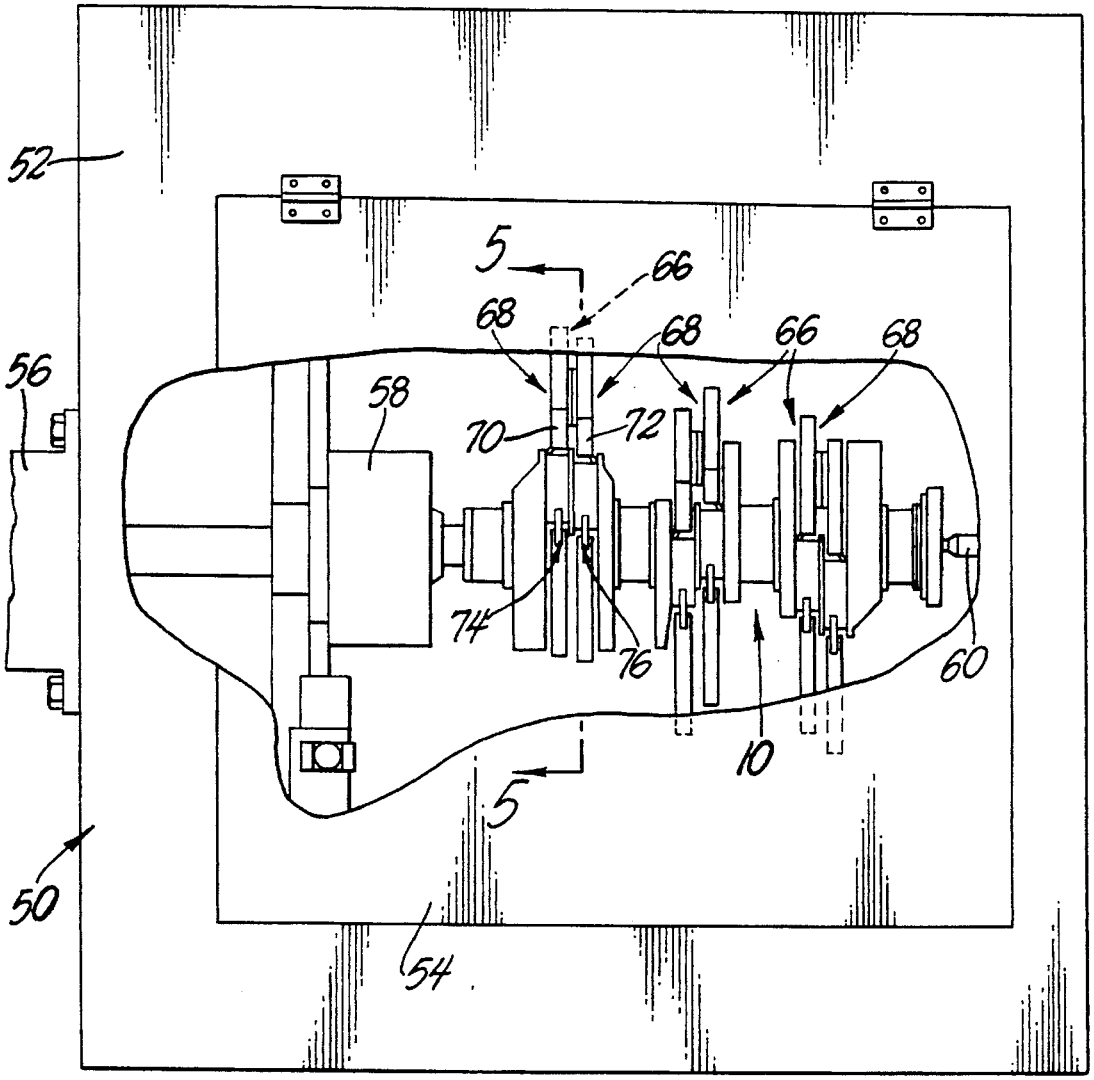
FIG. 4 is a pictorial side view with parts broken away of a machine for rolling fillets of split-pins of a crankshaft.

Importantly, the left bank pin 24 of each of the pairs of split-pins 16 are arcuately offset from the right bank pins 26 by a predetermined angle, such as 30 degrees, to provide for an even firing engine as diagrammatically shown in FIG. 3. The cross hatched area "A" is the theoretical connecting interface between the two pins 24 and 26 and is, in general configuration, shaped as the longitudinal cross-section of a football. As shown, this area of connection is only a fraction of the area of the circles representing the ends of the pins 24 and 26 and accordingly defines weakened areas of the crankshaft.

These areas and the associated pin journals being the most highly stressed parts of the crankshaft during engine operation often need to be strengthened so that deep rolling of the pin fillets is particularly important. Since the pins are arcuately offset or split as described above, a fence 32 is needed between pins 24 and 26 at their interface so that inboard fillets 38, 40 (FIG. 6) on opposite sides of the fence 32 can be deep rolled 360 degrees with high precision.

Importantly, with this invention, the arcuate segments or limbs 42 and 44 of the fillets of the pins compassing the "football" area A are deep rolled at higher loads than the remaining segments of the fillets to provide improved yield strength. This deep rolling materially improves strength in such zones where bending fatigue failure may otherwise originate.

For a first stage of deep fillet rolling of the pins, the crankshaft 10 is loaded into a first fillet rolling machine 50 that has a housing 52 with an access door 54 hinged to the side panel thereof. A drive motor 56, mounted to the exterior of the housing, is selectively energizable to rotatably power a drive chuck 58 and the crankshaft 10 which has been loaded into chuck and supported by a center point 60 within the housing. When the drive motor is energized and torque is transmitted to the chuck, the crankshaft 10 is turned about its longitudinal axis 22. The fillet rolling tooling within the housing comprises three sets 66 of paired clamping jaw arms or units 68 that have clamping jaw ends that carry fillet rolling tools 70, 72 and opposing pin supporting tools 74, 76.

Figure 5:
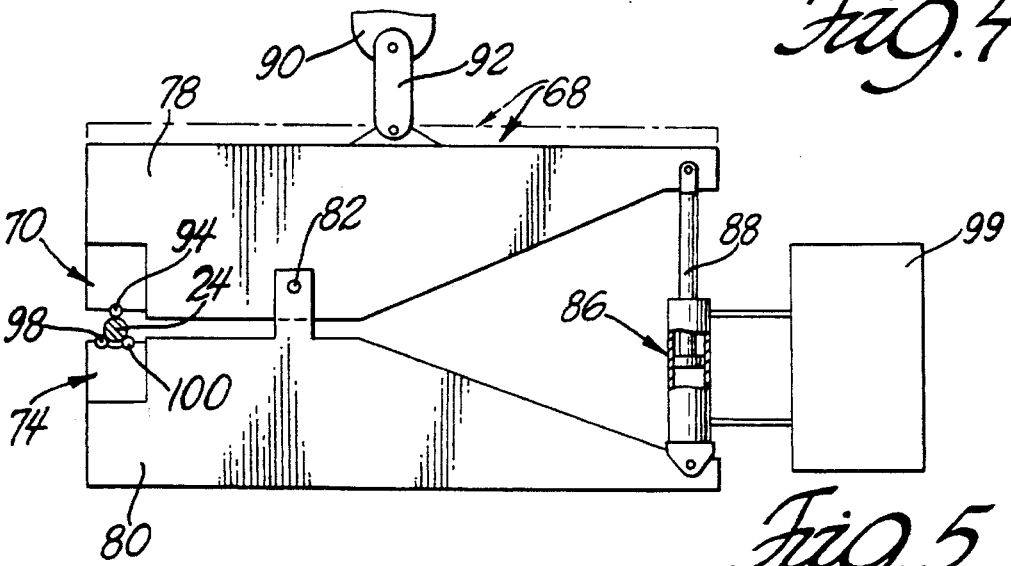
FIG. 5 is a view taken generally along lines 5—5 of FIG. 4 modified to diagrammatically show deep rolling of pin fillets.

FIG. 5 diagrammatically illustrates one pair of the clamping jaw arms 68 comprising upper and lower jaw arms 78, 80 pivoted to one another by an intermediate pivot 82. The fillet rolling and pin supporting tools, such as rolling tool 70 and support tool 74, are removably mounted in the free ends of the upper and lower jaws of the arms so that they directly oppose one another. The upper and lower jaw arms are pivoted about their common pivot 82 by action of a power cylinder 86 which may be a hydraulic actuator with a piston and rod 88 operatively mounted by pivots between the outboard ends of the upper and lower jaw arms.

Each pair of clamping jaws is operatively mounted to an upper support 90 within the housing by flexible mounting device, diagrammatically illustrated at 92 in FIG. 5, that connects the upper arm 78 to a support 90 within housing 52 so that the clamping jaw units 68 can rock or "float" in parallel plane as they follow the circular paths of the associated pins being rolled in response to the rotatable drive of the crankshaft 10.

The clamping jaw unit 68 of FIG. 5 is in a fillet rolling mode with a hardened work roller 94, carried by the rolling tool 70, engaged in outboard fillet 95 (FIG. 6), and with opposing back-up rollers 98, carried by tool 74 in opposition to the rolling tool supporting the split-pins. When predetermined expansion pressure is supplied to the power cylinder unit from controls 99, the lever arms, as provided by the clamping jaw arms, will multiply and transmit a predetermined rolling force to the associated fillet 95 so that it is deep rolled as the crank is turned about its rotational axis 22.

Figure 7:
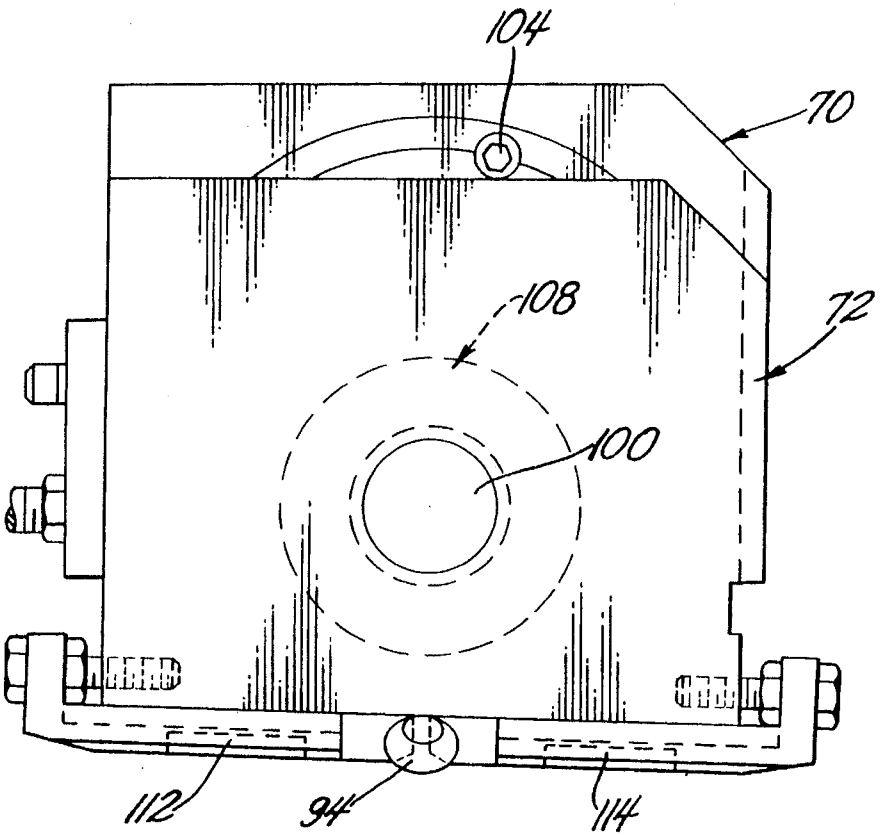
FIG. 7 is a side view of the tooling of FIG. 6 taken generally along sight lines 7—7 thereof but with the crankshaft omitted.
Figure 6:
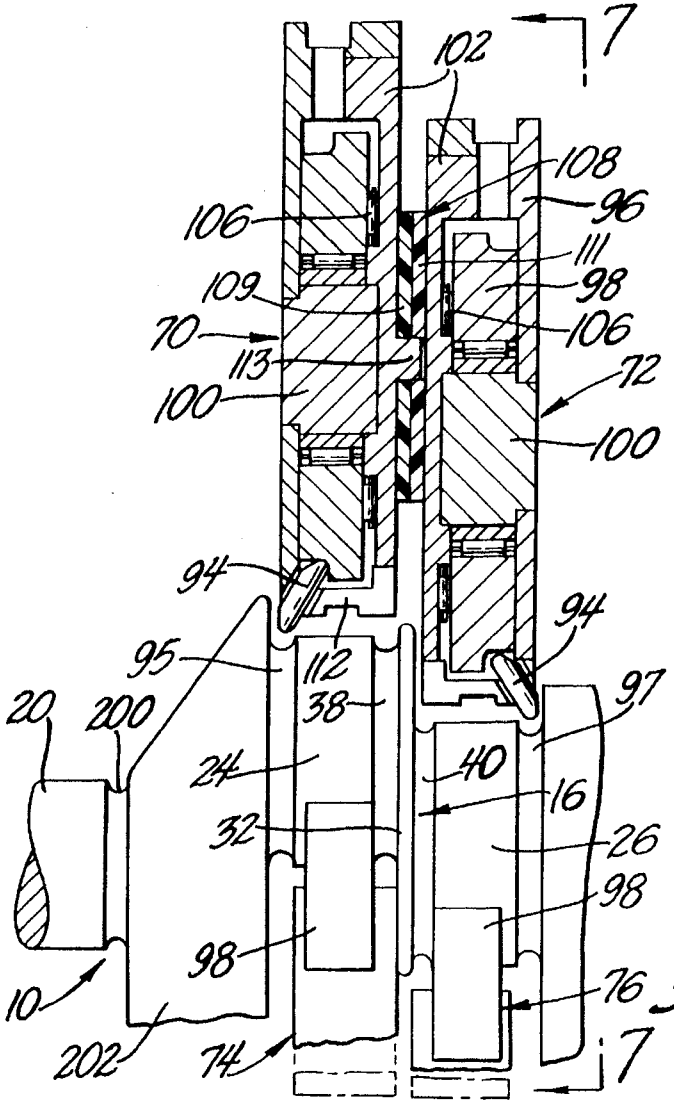
FIG. 6 is a sectional view of tooling for the machine of FIG. 4 with some parts in full lines used to roll outer fillets of a crankshaft.

FIGS. 6 and 7 illustrate details of the upper tools 70, 72 preferably used in one stage of rolling operation to roll the outboard fillets 95, 97 of one pair of split-pins 16. The tools are similar to those disclosed in the above cited parent application Ser. No. 8/176,792, and as shown are substantially identical so that the same reference numeral refers to common parts. Each tool comprises a generally rectilinear housing 96 hollowed to accommodate a generally cylindrical back-up roller 98 rotatably mounted by needle bearing unit supported on a cylindrical hub 100. Each housing is closed on its inboard side by a closure and bearing plate 102 and is fastened thereto by threaded fasteners 104. Needle thrust bearing units 106 are disposed between the inboard sides of the back-up rollers and the interior of the closure and bearing plates, as shown. Opposing side loads generated during the simultaneous rolling of fillets 38 and 40 are canceled at the centralized bearing unit 108 operatively mounted between the interfacing closure plates 102 of the adjacent rolling tools 70, 72.

This bearing unit may comprise a pair of annular and flat bearing plates 109, 111 of Teflon, Nylon or other suitable low friction plastics material with good wear characteristics supported on the centralized post 113 extending axially from the tool 70 and sandwiched between the tools 70, 72. This flat bearing unit spreads the side loads while allowing the housing to easily move relative to one another during rolling.

The outboard fillet rollers 94, 94 for each of the split-pins 16 are adjustably mounted on the lower ends of the tools 70, 72 by carriers 112, 114. As shown best in FIG. 5, the fillet rollers 94, 94 are operatively mounted in the cages formed between the inner ends of the carriers and are rotatably supported therein so that they are inclined at a predetermined angle such as 45 degrees for deep rolling the outboard fillets 95, 97. The tools 74 and 76 of the lower jaw arm have supported rollers 98 providing support for the pins 24, 26 during fillet rolling.

With this construction, the outboard fillets 95 and 97 are rolled 360 degrees by the rotatable driving of the crankshaft about its axis in response to the operation of the motor 58. Since the clamping jaw arms loaded by a selected force exerted by cylinder 86, the outboard fillets will be deep rolled through 360 degrees with the hardened rollers 94 compacting and rolling compressive stresses to the grain structure of the fillets to provide the desired strengthening.

Figure 8:
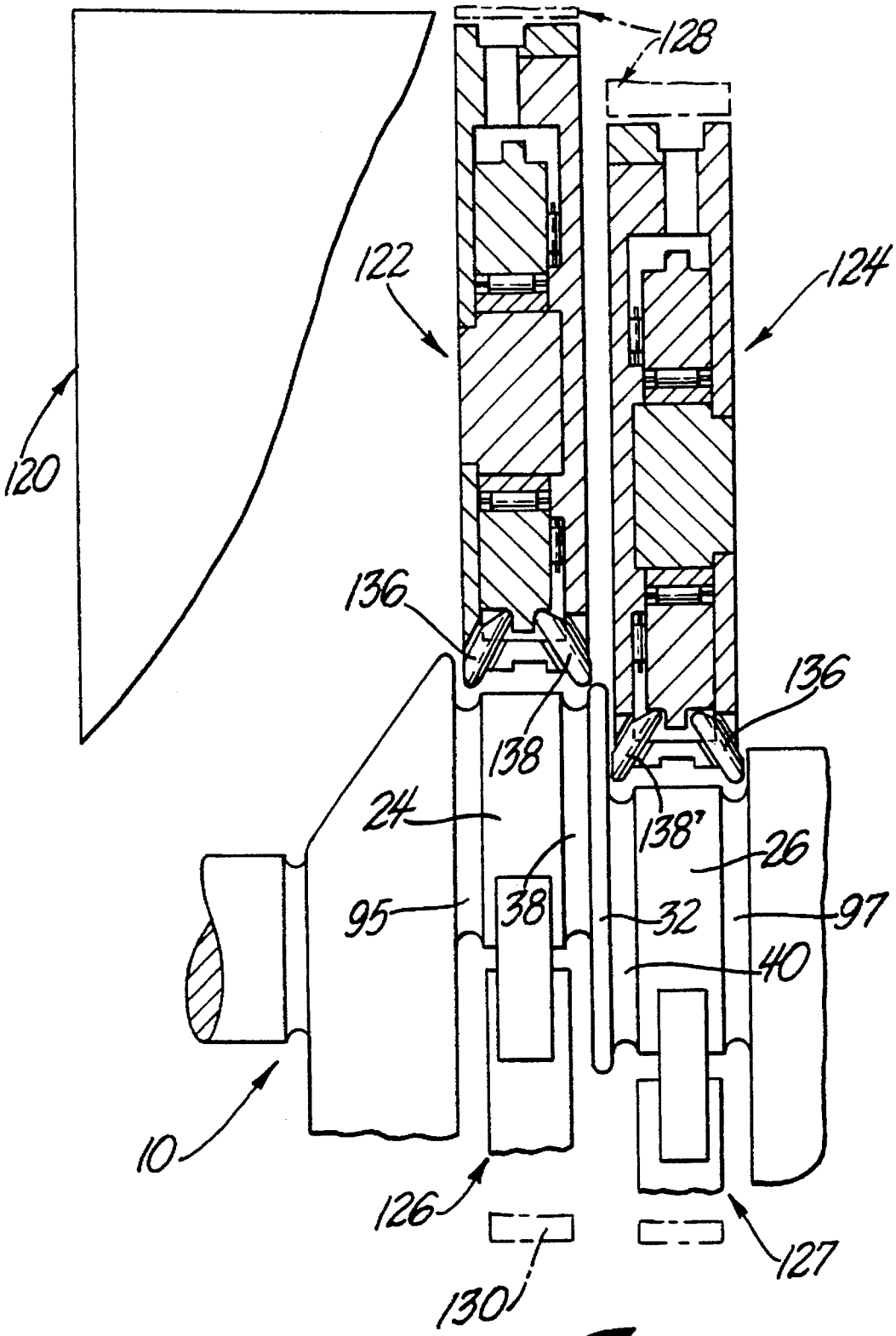
FIG. 8 is a view similar to a view of FIG. 6 showing different tooling for rolling both the outer and the offset interior fillets of a split-pin journal.

After this first rolling operation, the tools 70, 72 of the first machine 50 are removed so that the machine 50 can be retooled with second side-by-side upper rolling tools 122, 124 of FIG. 8 for the deep rolling of the inner fillets 38 and 40. Optionally, the crankshaft 10 may be removed from the first machine 50 and conveyed and loaded into a second fillet rolling machine 120 tooled to deep roll the inner fillets 38, 40 of pins 24, 26, respectively. The second side-by-side upper rolling tools 122, 124, and lower pin support tools 126 and 127, such as shown in FIG. 8, are employed at the work ends of three sets of jaw arms 128 which correspond to the sets of jaw arms 66 of the first machine.

Figures 9, 10:
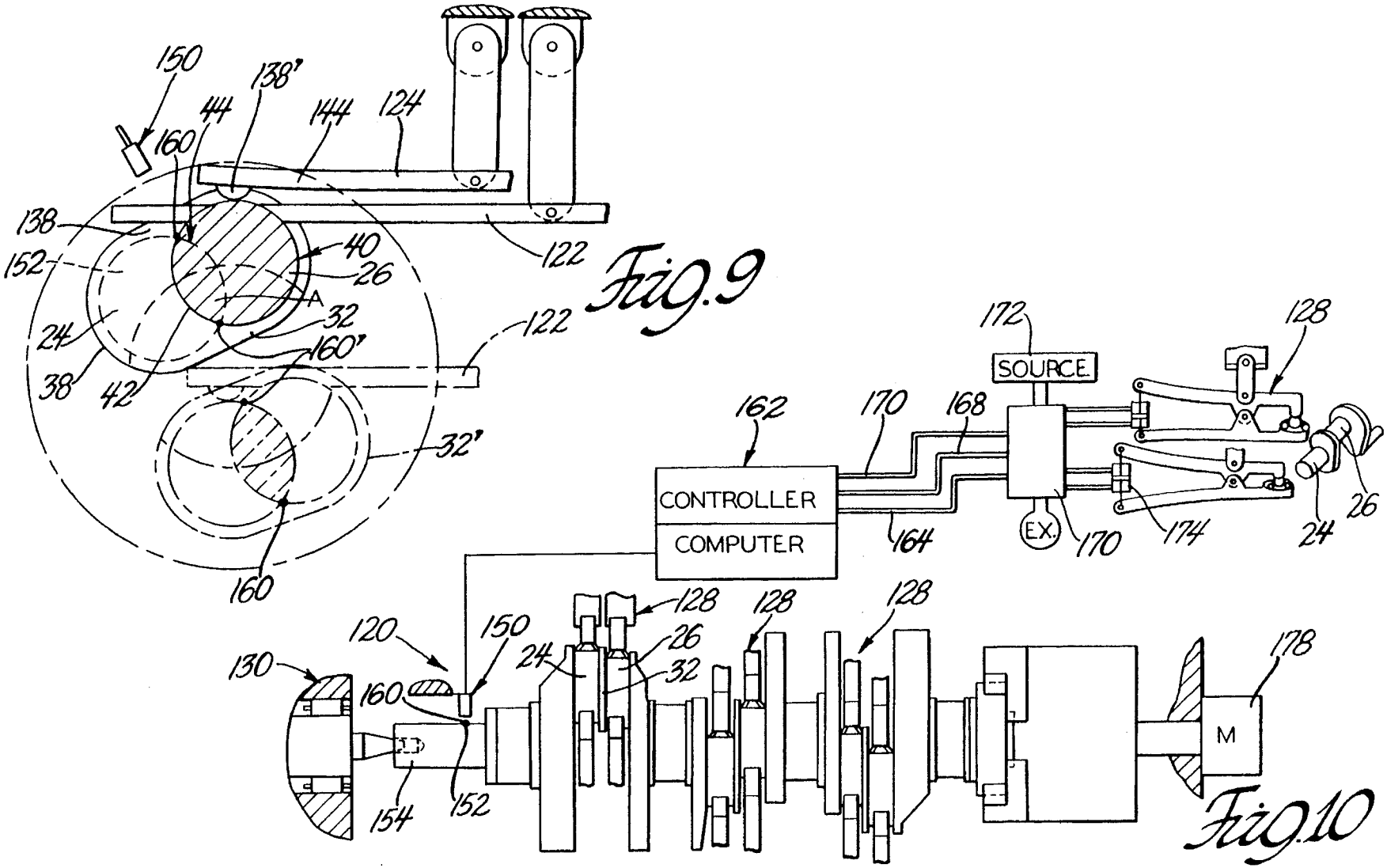
FIG. 9 is a diagram illustrating rolling of overlapping fillets of split-pins.
FIG. 10 is a diagrammatic view of the pressure controlled rolling of offset crank pin fillets.
Figure 11:
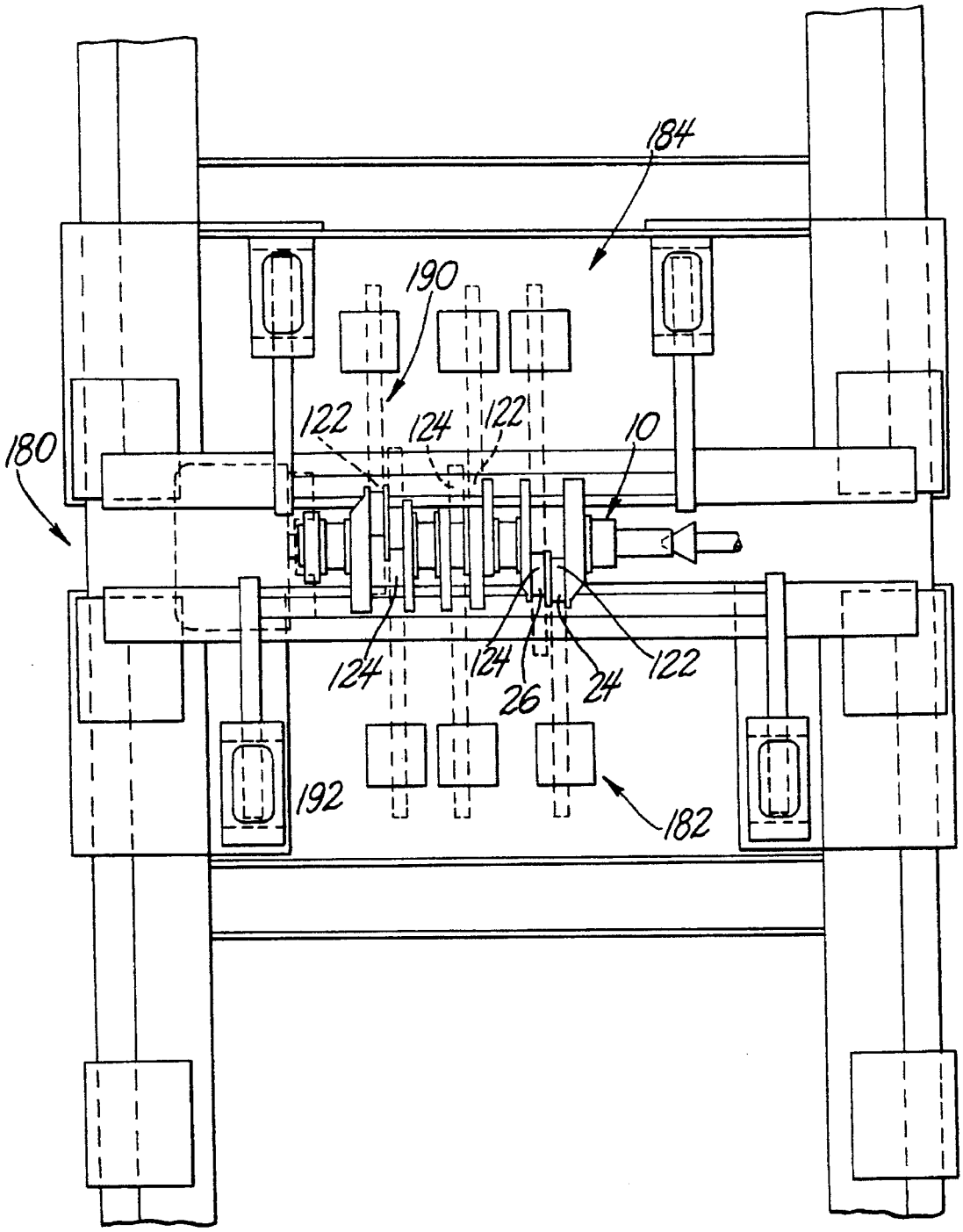
FIG. 11 is a top view of another machine for rolling all six interior offset crank pin fillets simultaneously.

In any event, the upper and lower tools 122, 124 and 126, 127 correspond to the tools of parent application Ser. No. 08/242,262 and are similar to the tools of FIG. 6 of the first rolling machine. However, instead of having only outboard rollers as in those Figures, the upper tools have outboard fillet rollers 136 and 136', and inboard fillet roller 138 and 138' for respectively re-rolling the outer fillets 95, 97 and for initially rolling the inboard fillets 38, 40 on opposite sides of the fence 32 splitting pins 24, 26. Since the split pins 24, 26 are arcuately offset and the area of pin to pin connection is reduced, the inner fillets 38, 40 thereof are markedly strengthened by deep rolling with very high rolling loads in the area of pin overlap. This overlap is shown as cross-section "A" in FIGS. 3 and 9, and is compassed by limb 42 of fillet 38 and limb 44 of fillet 38. At the arcuate sections of fillets 38 and 40 beyond the overlap defined by limbs 42 and 44, the fence 32 has no back-up from the overlap so deep rolling must be executed with a lower rolling force, 0–100 newtons, for example only, so that fence 32 is not distorted by the rolling force in these arcuate segments.

The second machine features controls 148 for the simultaneous variable pressure rolling of the arcuately offset inboard fillets with high pressure rolling of the overlapping limbs 42, 44 or segments of the fillets for maximum strength and lower pressure rolling of the segments of the fillets outside of the overlap so that strengthening can be provided without distortion of the fence.

A pick-up 150, such as a rotational sensing device, such as an encoder, a programmable limit switch or a laser or magnetic unit secured in the rolling machine picks up a detection point 152 on a component, such as shaft 154, so that the position of the apex or intersection point 160 of the overlapping arcuate limbs 140 and 142 of fillets can be timely calculated for initiation of higher pressure rolling of the overlap. Signals from the sensing device 150 are fed to a freely programmable computer 152, such as Siemens SMP-BUS System disclosed in U.S. Pat. No. 5,001,917 hereby incorporated by reference, that operates a controller 162 that controls the rotational speed of the fillet rolling machine, and which has outputs 164, 166 and 168 that signals a pressure control unit 170 for controlling the pressure feed from a source 172 to the hydraulic power cylinders, such as 174, for the sets of jaw units.

The detection point 152 may be on the counterweight or fence 32 or input shaft 154 which corresponds to a known point arcuately spaced a set number of degrees from intersection points 160, 160', the points of the apparent intersection of overlapping fillets 38 and 40.

The sensing device 150 senses the position of the detection point 152 relative to the deep rollers 138, 138' as the pins turn with the crankshaft 10 in the fillet rolling machine, such as machine 120. The controller 152 knowing the angular velocity at which the crankshaft 10 is being rotatably driven by the motor 178 of machine 120 determines the time at which the point 160 of fillet overlap will coincide with the contact of the associated roller 138' for initiation of high load rolling of overlap limb 42 of fillet 40 and the time at which the overlap point 160' will coincide with the contact of the roller 138 of the tool for high load rolling overlap limb 44 of fillet 38.

For example, the controller 162 timely signals the pressure control unit 170 which resultantly effects a rapid increase in pressure of the actuator 174 operatively connected between the outboard ends of the jaw arms. High regulated pressure is supplied to the actuator 174 so that a high load rolling force, 4000 newtons for example, is timely applied to the fillet 40 at or slightly past the start or point 160' of the apparent intersection. The controller knowing the extent of the arc or limb 42 of the apparent overlap and the angular velocity of point 160 will cause the pressure control unit 170 to timely reduce the pressure in the actuator 174 at the end of the limb, point 160, so that the segment of the fillet 40 outside of the overlap will be rolled at the desired lower pressure level 0 to 100 newtons, for example.

Accordingly, after the limb 42 of fillet 40 of pin 26 is deep rolled and the opposing point of apparent intersection 160 of limbs 42, 44 is reached the load applied by tool 124 and its roller 138' to fillet 40 is reduced by the controller 148 so that the remainder of the fillet 40 is rolled at reduced roller load where the connecting rod thrust load is not supported by the overlap or offset of the adjacent pin. In one preferred embodiment the limbs are deep rolled at a rolling load of 4000 newtons while the arcuate segments outside of said limbs are rolled at loads ranging between 0–100 newtons.

In a similar manner, the fillet 40 is rolled by the tool 122 with the apparent overlap limb 44 of the fillet rolled at a high rolling load and the remainder of the fillet rolled at a lower load.

FIG. 5 is a top view of a machine 180 having left and right banks of clamping jaw units 182, 184 which can be displaced between an open position and a closed position illustrated so that all of the crank pins 24, 26 of crankshaft 10 can be rolled in a single rolling operation. Tools 122, 124 in opposing sets of jaw units 190, 192 engage the interior fillets to deep roll the overlap of the fillets as previously described.

If single pairs of clamping jaws were employed instead of pairs of twin jaws, rolling of all pins at a single station could be accomplished by moving the machinery between first and second longitudinal stations relative to the crank or by moving the machine between fixed stations relative to the crankshaft 10.

FIG. 6 shows an annular fillet 200 outboard of counterweight 202 at the juncture of a main journal 20 of the crankshaft 10 and the counterweight 202. Since there is an overlap between the fillet 200 of main journal 20 and the fillet 95 of the outermost pin 24, the limbs of the overlap may advantageously be rolled at high pressure to increase the yield strength of this otherwise weakened area of the crank. Accordingly, this invention can be readily applied to any offset of cylindrical bearings whether they be pin to pin or pin to main journals.

While a preferred embodiment of the invention has been shown and described, other embodiments will now become apparent to those skilled in the art. Accordingly, this invention is not to be limited to that which is shown and described but by the following claims.

What is claimed is:

1. Method of deep rolling adjacent fillets of physically connected and adjacent and arcuately offset cylindrical bearing parts of crankshafts for internal combustion engines, each bearing part having an axis of revolution offset from the axis of revolution of the other part comprising the steps of:

(1) mounting said crankshaft in a fillet rolling machine;

(2) employing fillet rolling tools to engage the adjacent fillets of said bearing parts;

(3) relatively rotating said crankshaft and the fillet rolling tools;

(4) deep rolling said adjacent fillets of said adjacent and arcuately offset bearing parts so that the arcuate segment of said fillet of a first bearing part and the arcuate segment of a second bearing part which overlap one another are deep rolled at loads sufficiently higher than the arcuate segments of said fillets which are free from overlapping so said the overlapping arcuate segments of said fillets have high residual stresses imparted thereto to thereby strengthen the physical connection between the bearing parts.

2. A method of deep rolling fenced fillets of split pairs of cylindrical crank pins of crankshaft for internal combustion engines with each pin of each pair having an axis of revolution offset from the axis of revolution of the other pin of said each pair and having a fence separating the interior fillets of each pair of pins comprising the steps of:

(1) mounting said crankshaft in a fillet rolling machine;

(2) employing fillet rolling tools to engage the innermost fillets of at least one of said split pair of crank pins with said fence separating said innermost fillets;

(3) relatively rotating said crankshaft and the fillet rolling tools;

(4) deep rolling said innermost fillets of said one of said split pairs of crank pins so that the arcuately fenced segments of said fillet of said first pin and the arcuate fenced segments of said second pins that overlap one another are deep rolled at loads sufficiently higher than the arcuate segments of said fillets which are free from overlapping so that the fillets of the connecting portion of said pins have high residual stresses to strengthen the physical connection between the pins from while eliminating distortions of said fence by rolling.

3. A method of deep rolling pairs of annular fillets of split and arcuately offset crank pins of a metallic crankshaft for an internal combustion engine separated by a fence at the split of the pins and wherein said fillets lie in separate planes and are offset so that said circular fillets overlap to define an overlap area bounded on one side by limb of one of said fillets and on the other side by a limb of another of said fillets, said limbs intersecting one another at opposite ends thereof to define first and second points of intersection and defining the extent of said areas of overlap comprising the steps of:

(1) installing the crankshaft in a fillet rolling machine so that a first fillet roller operatively contacts a first of said fillets and a second of said fillet rollers operatively contacts a second of said fillets, (2) rotating said crankshaft so that said pins and fillets are rotated, (3) deep rolling the limb of a first of said fillets a high load while rolling the arcuate portion of a second of said fillets outside of the limb thereof with a low load, and (4) deep rolling the limb of a second of said fillets with a high load while rolling the arcuate portion of said first fillet outside of the limb thereof at a low load, (5) removing said crankshaft from said fillet rolling machine.

4. A method of deep rolling pairs of fillets of split pins of a crankshaft for an internal combustion engine which are adjacent to one another and are on opposite sides of a divider fence separating the pins at the split thereof, said fillets being circular and arcuately offset from one another to describe an overlap area compassed by first and second opposed arcuate limbs which intersect one another at first and second intersect points comprising the steps of:

(1) loading the crankshaft into a fillet rolling machine, (2) engaging a first of said fillets of said pair of fillets with a first fillet rolling tool of said machine and a second of said fillets with a second fillet rolling tool, (3) turning said crankshaft relative to said rolling tools, (4) deep rolling said first and second limbs of said fillets defining said overlap area with a high pressure to cold-work localized arcs of said fillets which define said limbs to thereby strengthen and optimize the bending yield strength thereof, (5) rolling the arcuate segments of said fillets outside of said limbs with rolling loads that are substantially lower than said loads applied to said limbs to strengthen said segments while ensuring that said fence separating said pins is not distorted by said rolling loads.

5. The method defined in claim 4 in which the deep rolling of first and second limbs comprising the step of deep rolling only a first limb of said fillets at a high rolling pressure while the arcuate section outside of second limb of said fillets is rolled at lower pressure and then subsequently deep rolling the second limb of said fillets at a higher rolling while the arcuate section outside of said first limb is rolled at a lower pressure.

6. A pair of tools for deep rolling the outboard fillets of pairs of pins of a shaft of an internal combustion engine, first and second tool housings, a roller carrier at the lower end of each housing, a roller in each of said carriers for engaging and rolling the outboard fillets of the pair of pins, floating jaw arms for each of said housing and flattened bearing plate means disposed between said housings to cancel the side loads developed by the rolling of said fillets by said rollers.

* * * * *